US005628361A

United States Patent [19]

Getto

[11] Patent Number: 5,628,361

[45] Date of Patent: May 13, 1997

[54] HEAT EXCHANGE MANIFOLD

[75] Inventor: Christophe R. Getto, Villerupt, France

[73] Assignee: General Motors Corporation, Detroit, Mich.

[21] Appl. No.: 620,198

[22] Filed: Mar. 22, 1996

[30] Foreign Application Priority Data

Aug. 25, 1995 [GB] United Kingdom ..... 9517449

[51] Int. Cl.[6] ..... F28F 9/02

[52] U.S. Cl. ..... 165/67; 165/173; 29/890.052

[58] Field of Search ..... 165/67, 76, 173; 180/68.4; 29/890.052

[56] References Cited

U.S. PATENT DOCUMENTS

| | | | |
|---|---|---|---|
| 5,125,454 | 6/1992 | Creamer et al. | 165/173 |
| 5,172,762 | 12/1992 | Shinmura et al. | 165/173 |
| 5,236,042 | 8/1993 | Kado | 165/149 |
| 5,246,066 | 9/1993 | Morgan et al. | 165/173 |
| 5,343,620 | 9/1994 | Velluet | 29/890.043 |

FOREIGN PATENT DOCUMENTS

| | | | |
|---|---|---|---|
| 4-6397 | 1/1992 | Japan | 165/173 |
| 2049149 | 12/1980 | United Kingdom | 165/173 |

*Primary Examiner*—Allen J. Flanigan
*Attorney, Agent, or Firm*—Patrick M. Griffin

[57] ABSTRACT

A heat exchanger comprising a pair of manifolds (42) which are spaced apart and substantially parallel; a plurality of tubes (44) interconnecting the manifolds, the tubes being spaced apart, substantially parallel, and inserted through slots (54) in the manifolds; an inlet tube connected to one of the manifolds; an outlet tube connected to one of the manifolds; a mounting bracket (66) attached to each manifold; and a stop member (56) positioned inside each manifold adjacent the slots which acts as an abutment for the inserted tubes; wherein each manifold with associated bracket and stop member is formed in one piece.

5 Claims, 3 Drawing Sheets

HEAT EXCHANGE MANIFOLD

The present invention relates to a heat exchanger, and in particular to a method of manufacturing a heat exchanger.

A heat exchanger typically comprises a pair of substantially parallel header or tank manifolds interconnected by substantially parallel tubes through which fluid can flow between the manifolds. Heat conducing fins are generally secured between the tubes to promote heat conduction. Inlet and outlet tubes are secured to the manifolds, as are mounting brackets for the heat exchanger. The various components are typically formed from aluminum or aluminum alloy having a cladding which allows brazing or welding together of the components. The manifolds are either formed by rolling sheet material to form a tube with abutting longitudinal edges and then brazing the abutting edges, or are formed from extrusion in one piece or two pieces which are joined together. Slots are cut in the manifolds. The tubes are inserted into the slots with the fins positioned between the tubes. End caps are positioned in the open ends of the manifolds, and inlet and outlet tubes are positioned in the manifolds. The assembly is then heated to braze or weld the components together. The mounting brackets are attached either before or after heating.

It is an object of the present invention to provide an improvement to the previously known arrangements.

A heat exchanger in accordance with the present invention comprises a pair of manifolds which are spaced apart and substantially parallel; a plurality of tubes interconnecting the manifolds, the tubes being spaced apart, substantially parallel, and inserted through slots in the manifolds; an inlet tube connected to one of the manifolds; an outlet tube connected to one of the manifolds; a mounting bracket attached to each manifold; and a stop member positioned inside each manifold adjacent the slots which acts as an abutment for the inserted tubes; wherein each manifold with associated bracket and stop member is formed in one piece.

The present invention also includes a method of forming a heat exchanger as herein defined comprising the steps of forming each manifold with associated bracket and stop member in one-piece; cutting the slots in each manifold; inserting each tube into its associated slot in each manifold until the tube abuts the stop member; and brazing the assembly together.

The present invention will now be described, by way of example, with reference to the accompanying drawings, in which.

Figure 1:
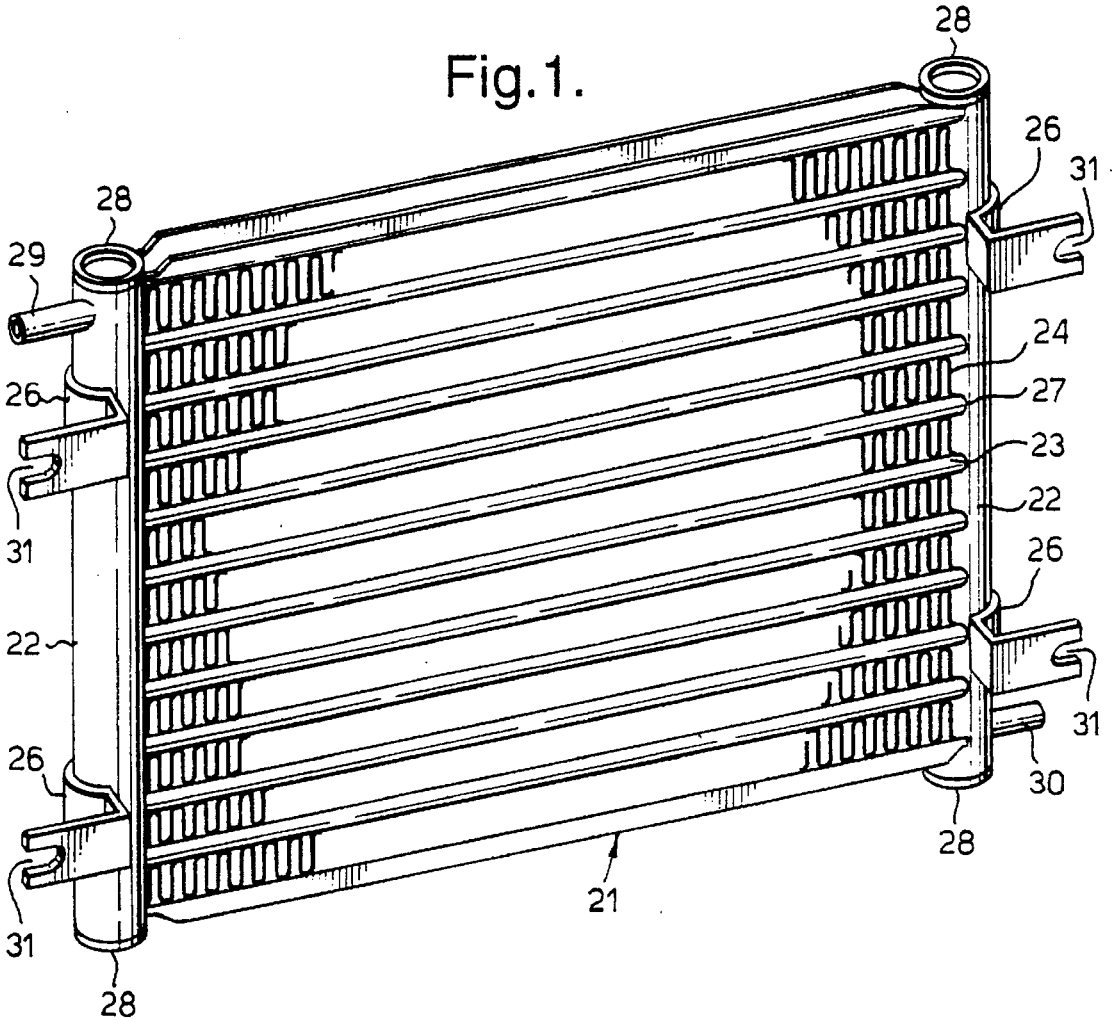
FIG. 1 is a side view of a prior known heat exchanger.
Figure 2:
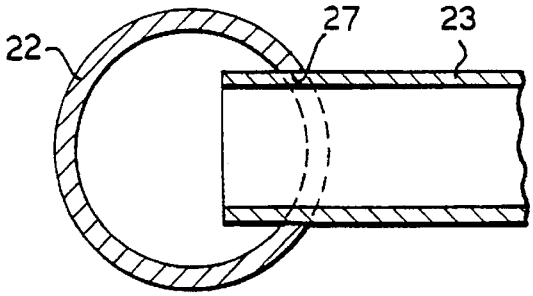
FIG. 2 is a cross-sectional view of one of the manifolds and tubes of the heat exchanger of FIG. 1.

A known heat exchanger 21 is shown in FIGS. 1 and 2. The heat exchanger 21 comprises a pair of substantially parallel tubular header or tank manifolds 22 which are closed at each end by end caps 28. Extending between each manifold 22 are a number of tubes 23 which are substantially parallel to one another and substantially perpendicular to the manifolds. Each end of each tube 23 passes through and is secured in a slot 27 in one of the manifolds 22. An inlet tube 29 is attached to one manifold 22, and an outlet tube 30 is connected to the other manifold. This arrangement allows fluid to flow from the inlet tube 29 through the manifolds 22 and tubes 23 to the outlet tube 30. Heat conducting or radiating fins 24 are positioned between and connect the tubes 23 to improve heat exchange between external air and the fluid. Mounting brackets 26 having fixing slots 31 or apertures are secured to the manifolds 22. The various components are formed from clad aluminum. The manifolds 22 can be extruded in one piece, or in two-pieces which are subsequently joined, or by rolling a sheet of material and joining the abutting longitudinal edges. The slots 27 are cut in the manifolds 22. The manifolds 22, tubes 23, fins 24, inlet tube 29 and outlet tube 30 are assembled together and then secured by brazing in an oven. The brackets 26 can be similarly attached, or may be attached by screws after the brazing of the assembly. This known arrangement has several disadvantages. The extrusion of the manifold 22 in one or two pieces is expensive both in terms of manufacture and in terms of subsequent machining steps that are required. The insertion of the tubes 23 into the slots 27 has to be precise to prevent over insertion (which can affect fluid flow through the header 22) or under insertion (which can lead to leakage at the joint between the tube and the manifold). The attachment of the brackets 26 is an extra assembly step.

Figure 3:
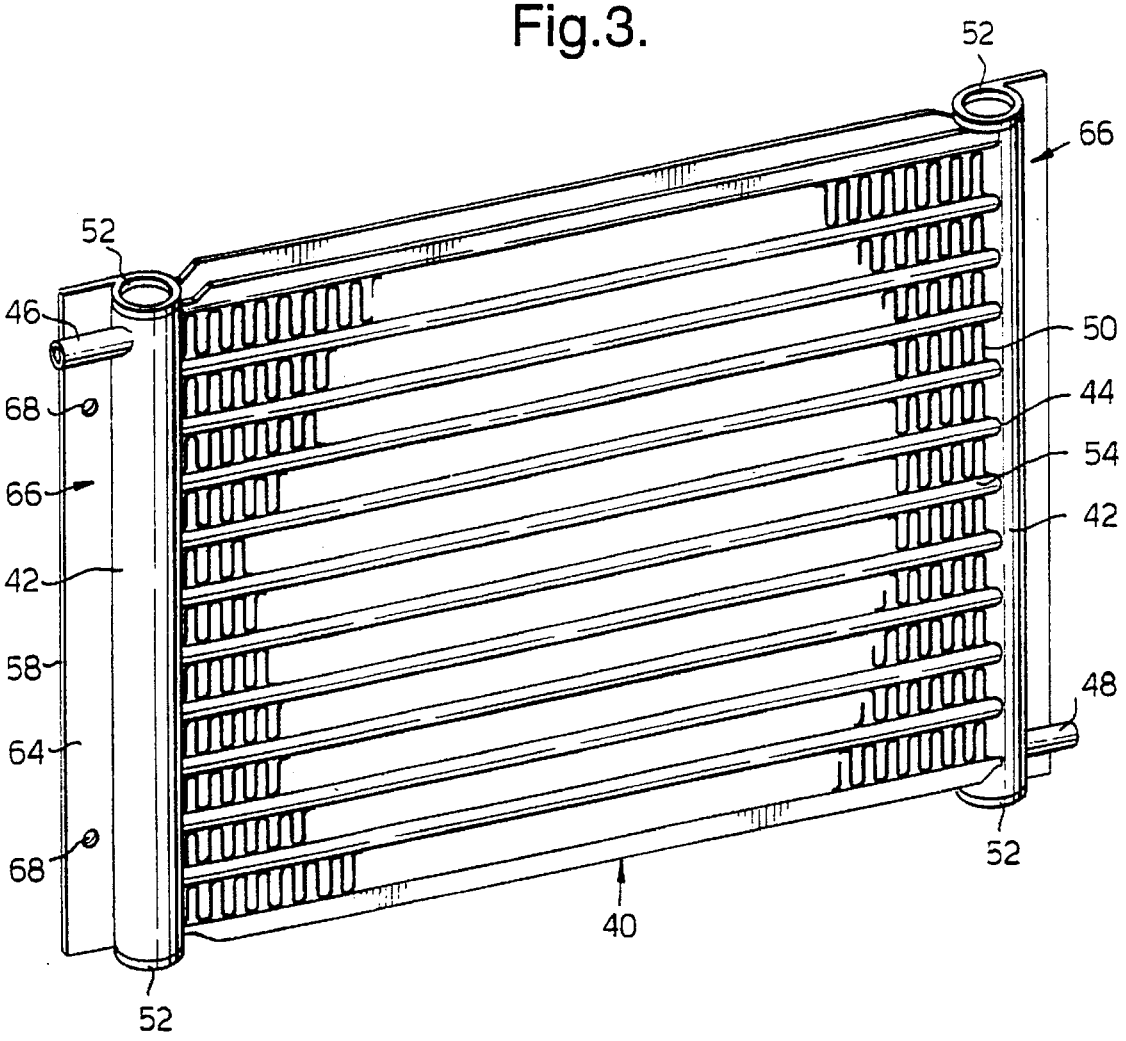
FIG. 3 is a side view of a heat exchanger in accordance with the present invention.
Figure 4:
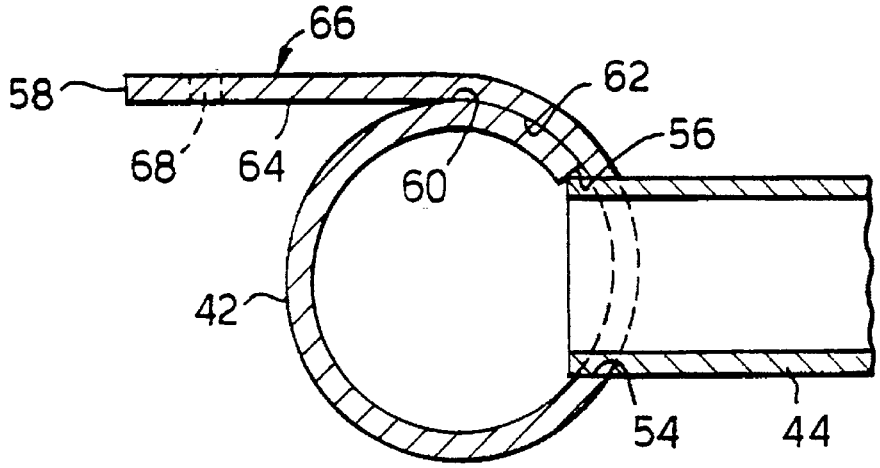
FIG. 4 is a view similar to that of FIG. 2 of the heat exchanger of FIG. 3.
Figure 5:
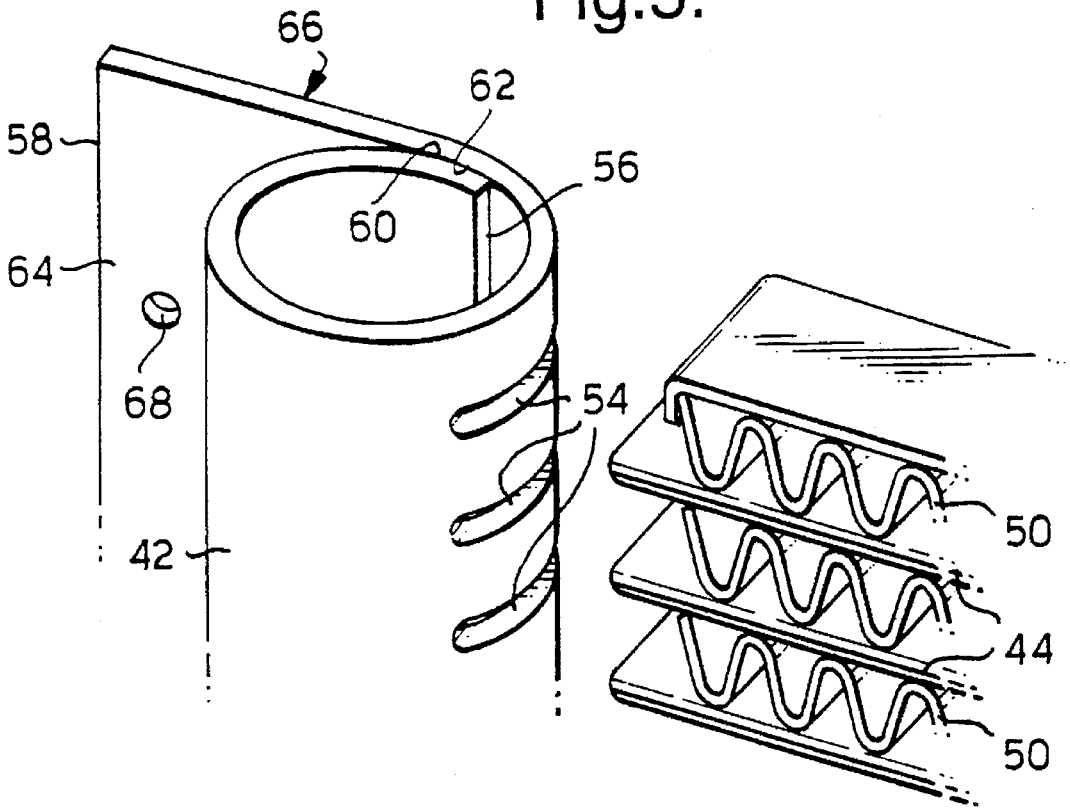
FIG. 5 is an exploded view of one of the manifolds and part of the assembly of tubes and fins of the heat exchanger of FIG. 3.

A heat exchanger 40 in accordance with the present invention is shown in FIGS. 3–5. The heat exchanger 40 comprises a pair of substantially parallel tubular header or tank manifolds 42. Interconnecting the manifolds 42 is a plurality of tubes 44 which are substantially parallel to one another, spaced apart, and have longitudinal axes substantially parallel to the longitudinal axes of the manifolds. The tubes 44 are fixed in slots 54 formed in the manifolds 42. The tubes 44 and manifolds 42 are connected to allow flow of fluid therethrough. A fluid inlet tube 46 is connected to one manifold 42, and a fluid outlet tube 48 is connected to the other manifold. As an alternative, the inlet and outlet tubes may be connected to one manifold with suitable blanking plates positioned inside the manifolds to direct the flow of fluid. Heat conducting or radiating fins 50 are attached to adjacent tubes 44 to enhance heat exchange between the circulating fluid and external air. End caps 52 close the open ends of each manifold 42. As thus far described, the heat exchanger 40 is substantially the same as previously known arrangements and operates in substantially the same manner.

In accordance with the present invention, the manifolds 42 of the heat exchanger 40 are formed by rolling a sheet of clad aluminum or clad aluminum alloy. However, rather than abutting the longitudinal edges of the sheet, the sheet is rolled to leave one longitudinal edge 56 inside the manifold 42, and the other longitudinal edge 58 directed away from the manifold. Surface portions 60,62 of the sheet overlie each other and are in contact with each other. The portion 64 of the sheet between the overlapping portions 60,62 and the external longitudinal edge 58 lies at a tangent to the manifold 42 and defines a mounting bracket 66 for the heat exchanger 40. Mounting holes 68 or slots are formed in the bracket 66. The slots 54 in the manifold 42 are either formed in the sheet before rolling, or are formed in the rolled manifold. In the former case, the sheet is rolled such that the longitudinal edge 56 inside the manifold 42 is positioned adjacent the slots 54. In the latter case, the slots 54 are formed in the manifold 42 adjacent the longitudinal edge 56. In either of these arrangements, the longitudinal edge 56 provides a stop for the subsequently inserted tubes 44 to ensure correct insertion of the tubes.

After formation of the manifolds 42 with the integral mounting brackets 66, the tubes 44 are pushed into the slots 54 until the tubes abut the longitudinal edge 56. The remaining components of the heat exchanger 40 are assembled and the whole assembly brazed together by heating in an oven. The brazing step brazes together the overlapping surface portions 60, 62 of the manifolds 42.

In the arrangement shown in FIG. 4, each bracket 66 extends in a direction substantially parallel to the direction of the tubes 44. It will be appreciated that the direction of the brackets may be at any angle relative to the tubes dependent on the mounting requirements for the heat exchanger.

The present invention provides the manifold 42 and the mounting bracket 66 as a single part and in a single forming operation, thereby removing the additional steps of separately forming the brackets and then attaching the brackets. The present invention also provides a stop for the inserted tubes 44 in the same single operation of forming the manifold 42 and the bracket 66. This arrangement makes formation and assembly of the heat exchanger 40 easier and cheaper than previously known arrangements.

I claim:

1. A heat exchanger comprising a pair of manifolds which are spaced apart and substantially parallel; a plurality of tubes interconnecting the manifolds, the tubes being spaced apart, substantially parallel, and inserted through slots in the manifolds; an inlet tube connected to one of the manifolds; an outlet tube connected to one of the manifolds; a mounting bracket attached to each manifold; and a stop member positioned inside each manifold adjacent the slots which acts as an abutment for the inserted tubes; wherein each manifold with associated bracket and stop member is formed in one piece; and wherein each manifold with associated bracket and stop member is formed by rolling of a sheet of material to form the manifold with a longitudinal edge of the sheet positioned inside the manifold to define the stop member, and with a portion of the sheet directed away from the manifold substantially at a tangent thereto to define the mounting bracket.

2. A method of forming a heat exchanger as claimed in claim 1, comprising the steps of forming each manifold with associated bracket and stop member in one-piece; cutting the slots in each manifold; inserting each tube into its associated slot in each manifold until the tube abuts the stop member; and brazing the assembly together; wherein the forming step comprises rolling a sheet of material such that surface portions of the sheet overlap and abut to form the manifold, such that one longitudinal edge of the sheet is positioned inside the manifold to define the stop member, and such that a portion of the sheet is directed away from the manifold to define the bracket; the brazing step brazing together the surface portions.

3. A method as claimed in claim 2, wherein the slots for the tubes are cut in the sheet before rolling of the sheet to form the manifold, the said one longitudinal edge being positioned adjacent the slots at the end of the rolling step.

4. A method as claimed in claim 2, wherein the slots for the tubes are cut in the manifold after rolling of the sheet to form the manifold, the slots being cut adjacent the said one longitudinal edge.

5. A method as claimed in any one of claims 2, 3, or 4, where the heat exchanger is formed from clad aluminum or clad aluminum alloy.

* * * * *